United States Patent [19]

Besore et al.

[11] Patent Number: 4,848,581

[45] Date of Patent: Jul. 18, 1989

[54] PACKING SUPPORT FOR SLIDABLY MOUNTED ARTICLES WITHIN A CABINET

[75] Inventors: John K. Besore; Bruce L. Ruark, both of Louisville, Ky.

[73] Assignee: General Electric Company, Louisville, Ky.

[21] Appl. No.: 120,398

[22] Filed: Nov. 13, 1987

[51] Int. Cl.[4] ..... B65D 57/00

[52] U.S. Cl. ..... 206/521; 53/473; 206/320; 206/586; 206/594

[58] Field of Search ..... 53/396, 443, 473; 206/320, 576, 521, 586, 588–590, 594; 248/235, 247, 248, 250

[56] References Cited

U.S. PATENT DOCUMENTS

| | | | |
|---|---|---|---|
| 1,907,698 | 5/1933 | Albach . | |
| 2,008,335 | 7/1935 | Nuyts . | |
| 2,306,624 | 12/1942 | Harris . | |
| 2,663,417 | 12/1953 | Kincaid | 206/590 |
| 2,932,438 | 4/1960 | Smith | 206/320 |
| 3,559,866 | 9/1968 | Olson, Sr. | 206/521 |
| 4,027,794 | 6/1977 | Olson . | |
| 4,134,493 | 1/1979 | Cech . | |
| 4,182,450 | 1/1980 | Kryger | 206/586 |
| 4,341,308 | 7/1982 | Pasquini . | |

*Primary Examiner*—Jimmy G. Foster
*Attorney, Agent, or Firm*—Frederick P. Weidner; Radford M. Reams

[57] ABSTRACT

A pair of packing supports prevents movement during shipment of two shelves, which are slidably supported on vertically spaced shelf supports integral with inner side liners of a refrigerator cabinet. Each packing support, which is formed of corrugated cardboard, for example, has a shelf support portion wedged between two shelf supports on one of the inner side liners to prevent vertical and fore and aft motion of the packing support. Each packing support has a shelf retaining portion formed integral with the shelf support portion and bent at approximately 180° thereto. The shelf retaining portion receives one end of each of the shelves whereby it is compressed so that there is no motion of the packing supports towards each other.

23 Claims, 6 Drawing Sheets

FIG. 2
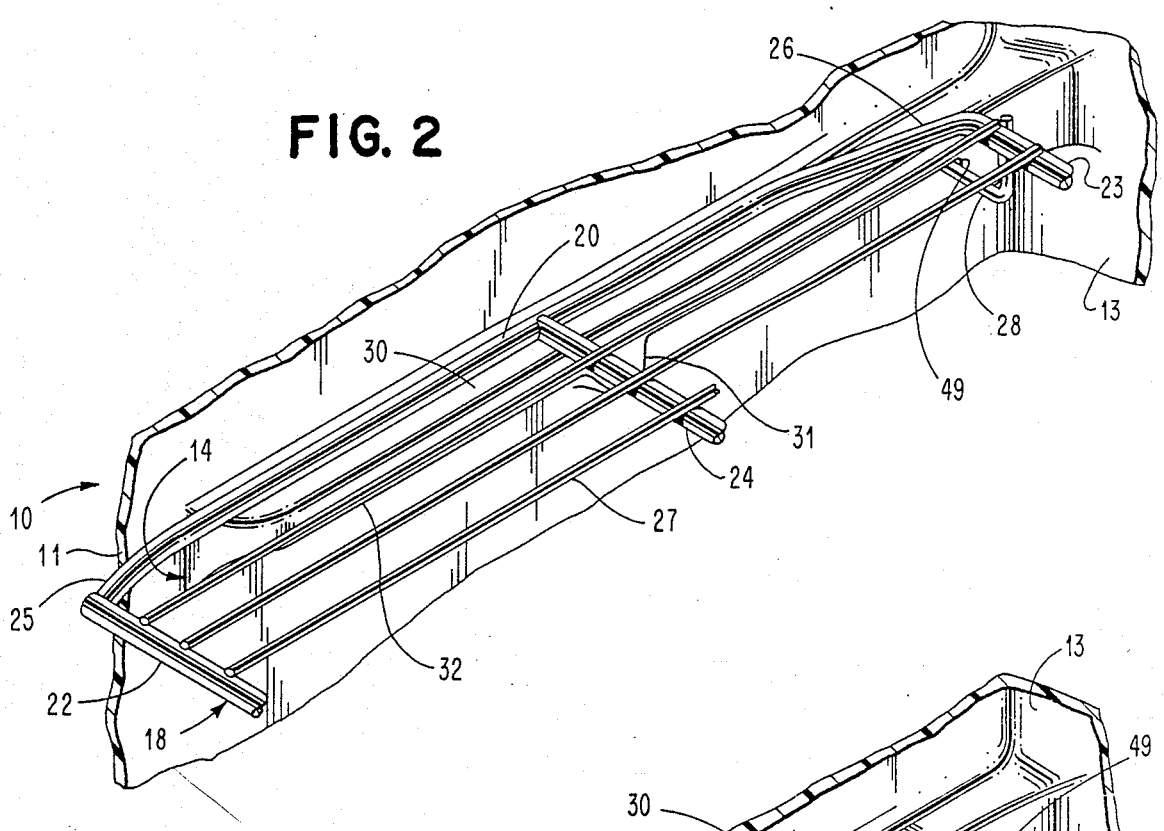
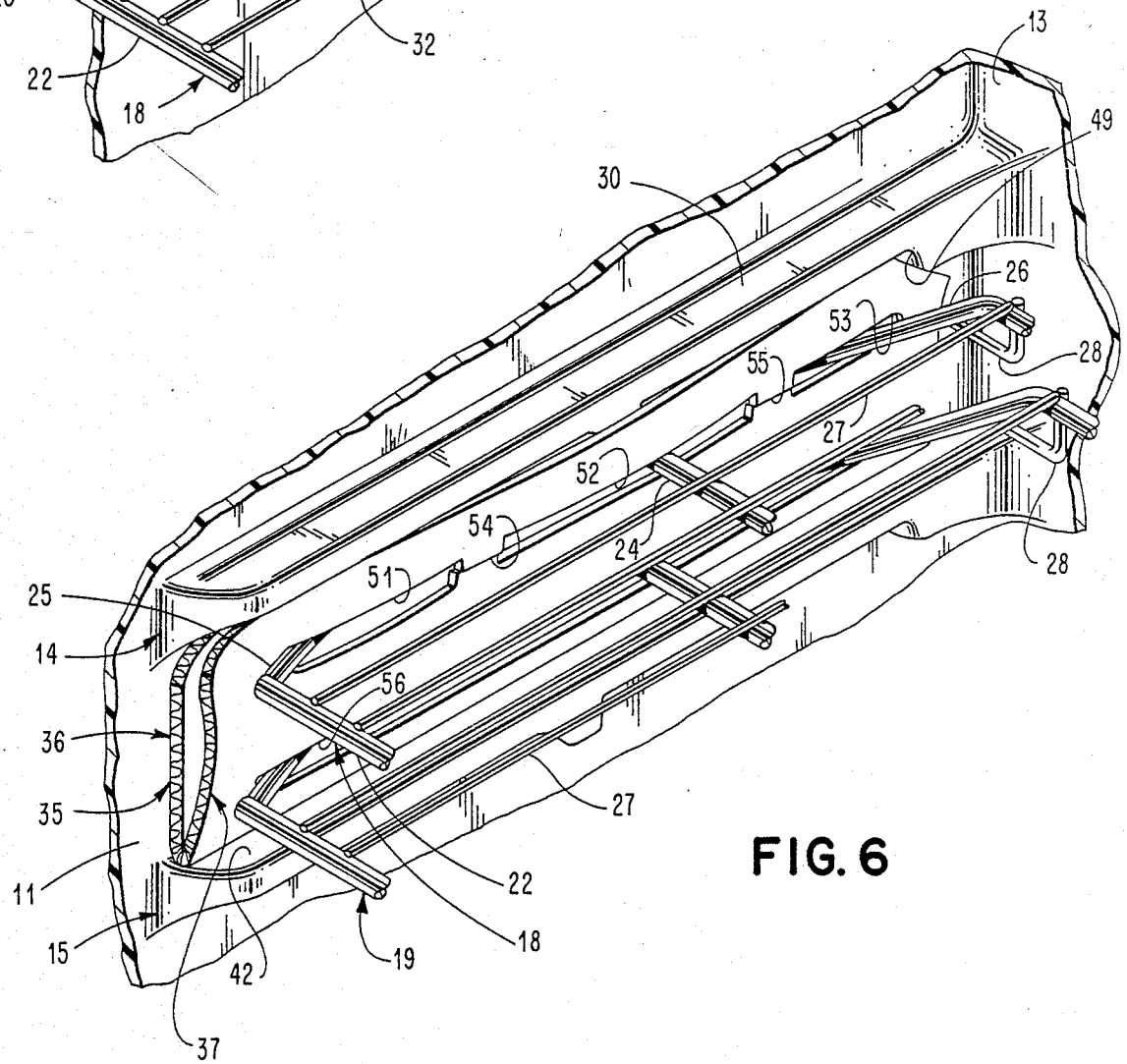
FIG. 6

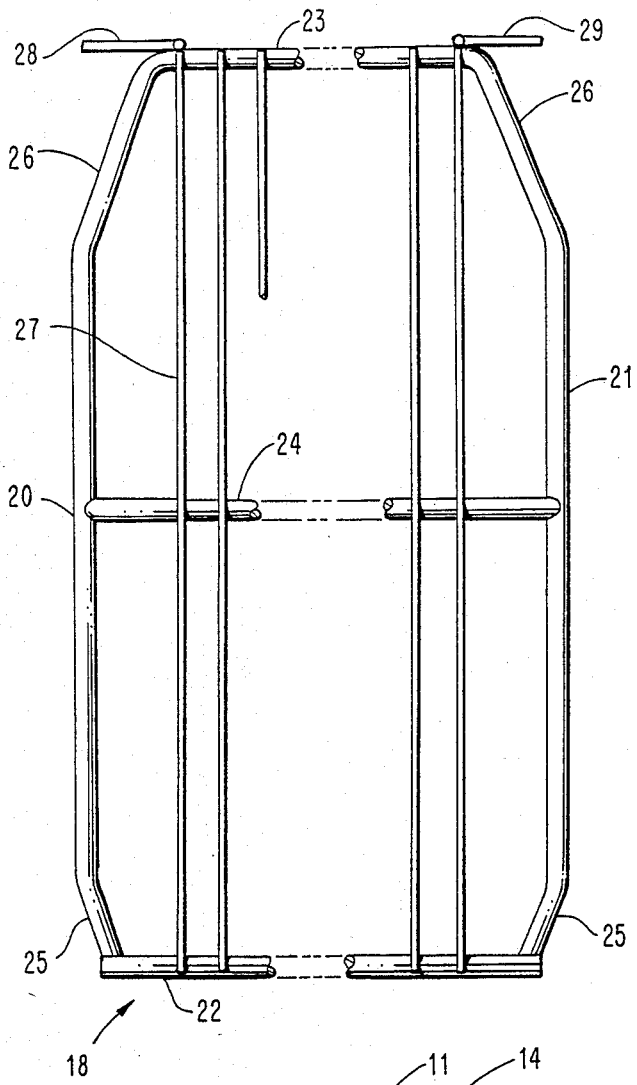
FIG. 3
FIG. 5
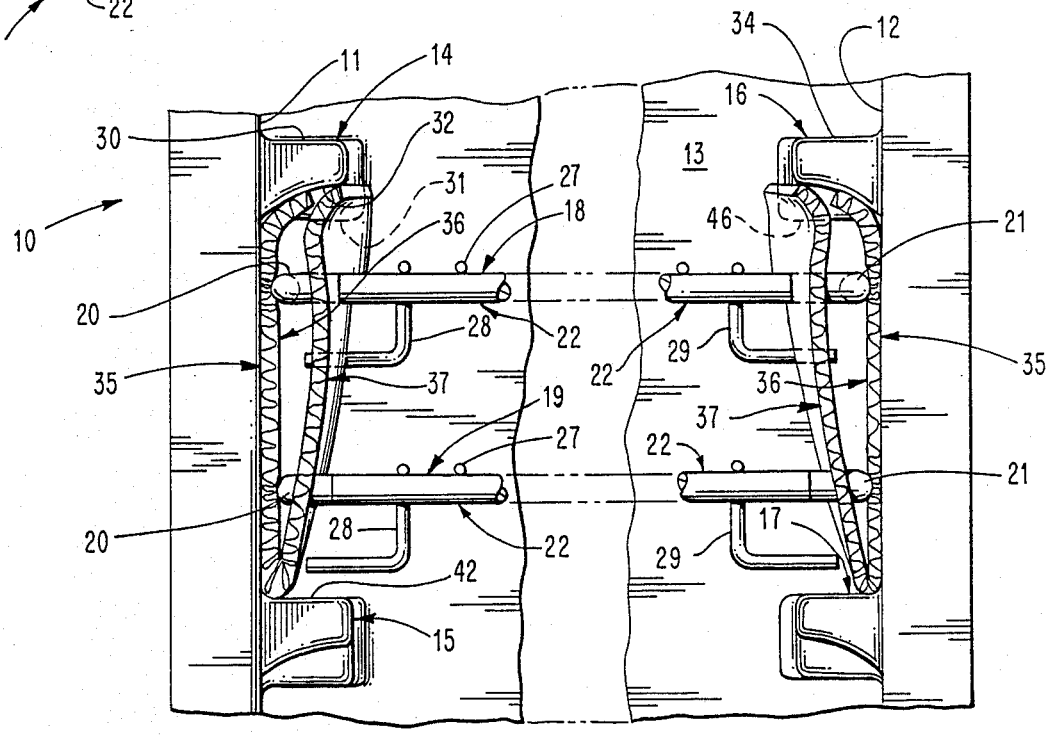

FIG. 7
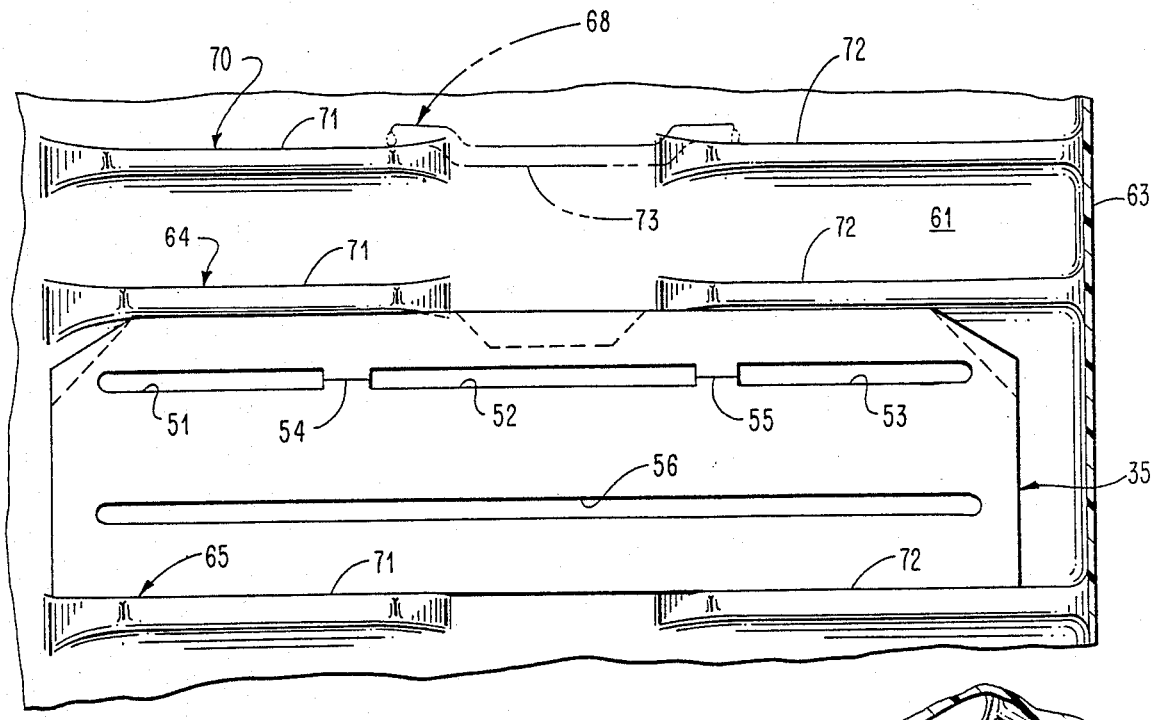
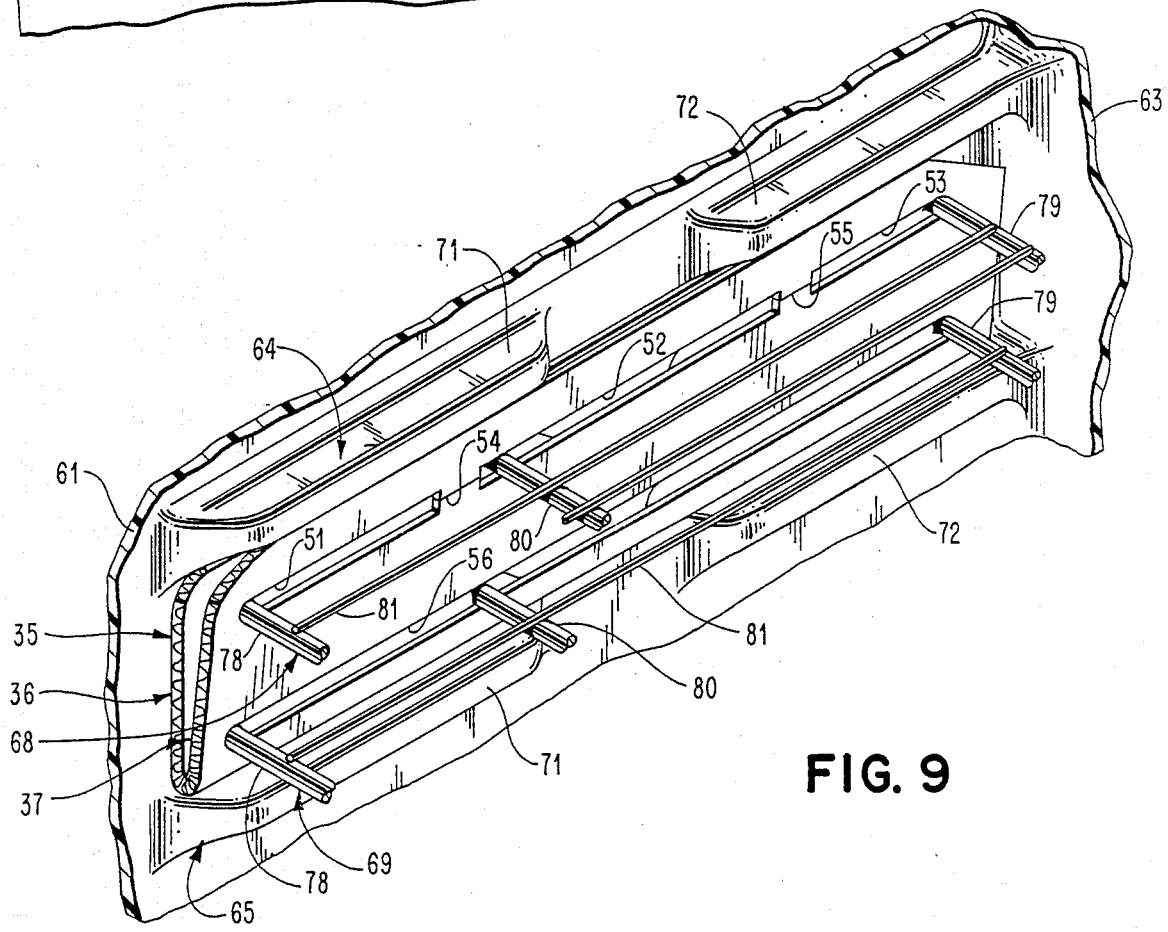
FIG. 9

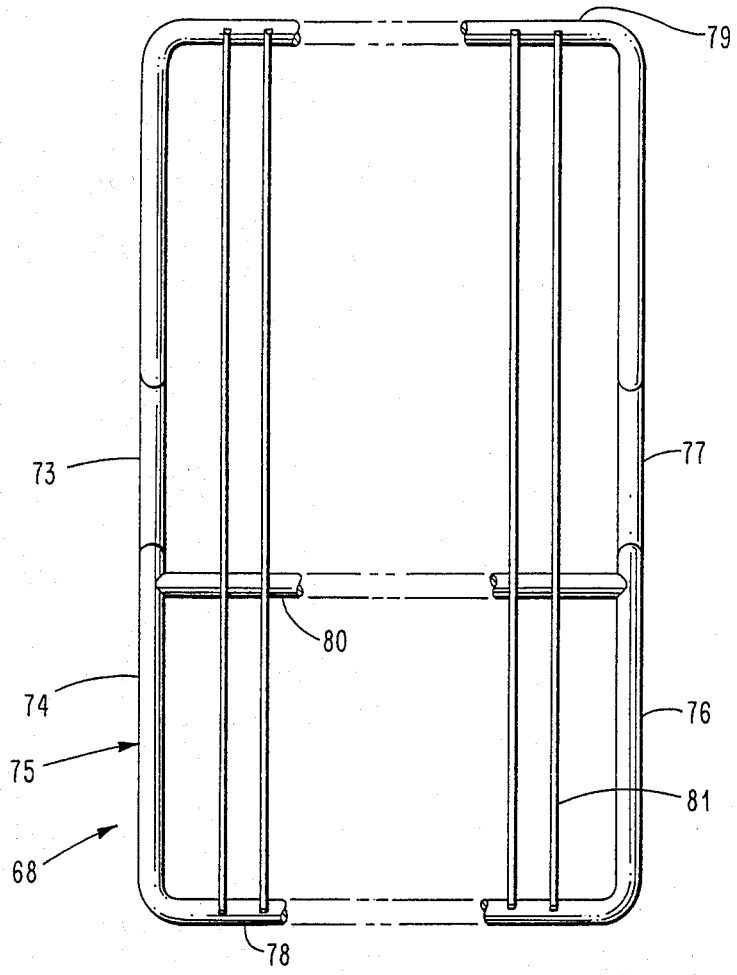
FIG. 8
FIG. 10
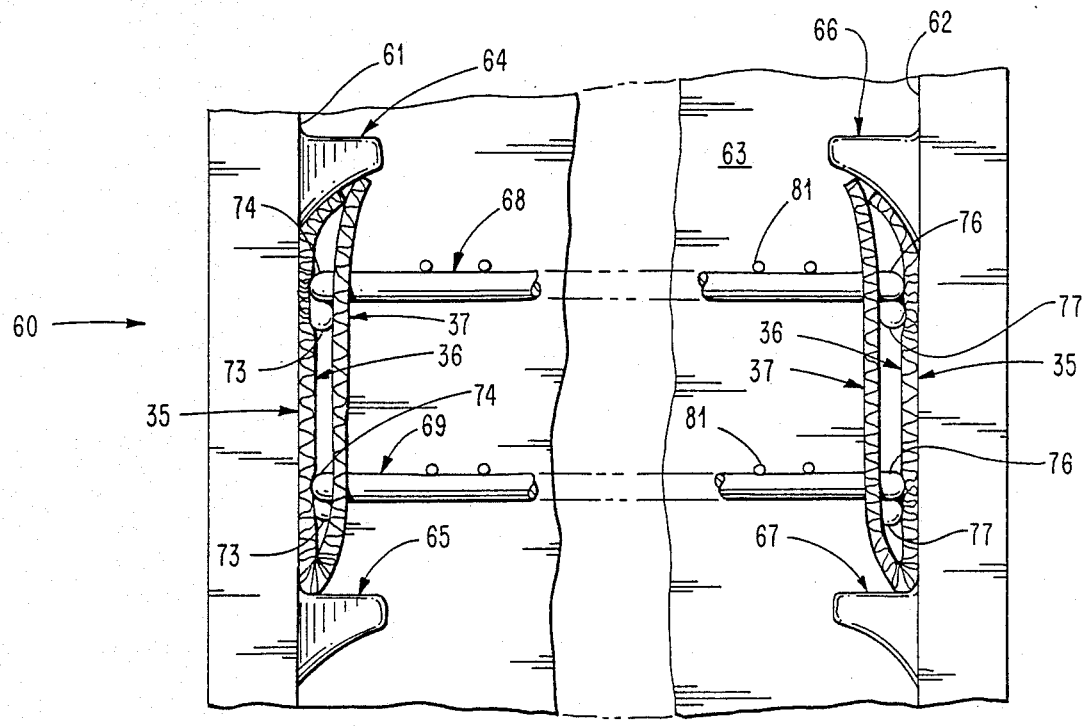

PACKING SUPPORT FOR SLIDABLY MOUNTED ARTICLES WITHIN A CABINET

FIELD OF THE INVENTION

This invention relates to a packing support for retaining slidably mounted articles against movement within a cabinet during shipment and, more particularly, to a packing support for preventing movement during shipment of articles slidably mounted on a pair of vertically spaced article supports integral with each side wall of the cabinet.

BACKGROUND OF THE INVENTION

Adjustable shelves are used in a refrigerator cabinet to enable a user to change the spacing between the shelves for various size articles to be supported thereon. In an economy refrigerator cabinet, the shelves are slidably supported on supports formed integral with each inner side liner of the refrigerator cabinet. To prevent the rear of the shelf from moving up or down after the shelf has its side bars resting on the shelf supports, one form of adjustable shelf has a hook at each rear corner of the shelf for retention beneath the bottom surface of the shelf support.

When shipping a refrigerator cabinet, the adjustable shelves must be prevented from vibrating or movement. Otherwise, the hooks, in particular, can pierce or gouge the liner.

During shipment, the refrigerator cabinet does not necessarily remain upright because it may be laid on its back or side. With the shelf having a hook at each rear corner, vibration of the hook during shipment would result in the hook piercing or gouging the liner irrespective of whether the refrigerator cabinet is upright, on its back, or on its side. Additionally, if the refrigerator is lying on its side, each side bar of the shelf also could pierce or gouge the liner during vibration.

Therefore, it is necessary to pack the shelves within the refrigerator cabinet so that they cannot vibrate during shipment of the refrigerator cabinet irrespective of whether the cabinet is upright, on its back, or on its side. Because the rear of the shelf cannot be fixed, the previously used tall corrugated post method for holding adjustable shelves in position cannot economically be utilized. The tall corrugated post method employs a triangular shaped corrugated post having its apex pointing toward the rear and wedged into the front of each shelf. This method requires the rear of each adjustable shelf to be retained in a mounting post, but this is not possible with an adjustable shelf having a hook at each rear corner as the only rear support for the shelf.

While an adhesive could be employed to hold each shelf in position during shipment, adhesive can come loose when subjected to ambient extremes. During shipment of a refrigerator cabinet, it can be subject to high or low ambient extremes so that the use of an adhesive to hold the shelf in position to prevent vibration of the shelf cannot be used.

The present invention overcomes the problems of the rear end of the shelf not being supported so that the tall corrugated post method is impractical of being used and the adhesive not adhering. Thus, the packing support of the present invention is capable of preventing vibration and motion of adjustable shelves of a refrigerator cabinet during shipment.

SUMMARY OF THE INVENTION

The packing support of the present invention is formed of a suitable material such as corrugated cardboard, for example, so that it has a slight memory retention whereby it will return to substantially its original position after removal of a force, which has moved a portion of the corrugated cardboard from its original position. The packing support includes a shelf support portion disposed between two vertically spaced shelf supports integral with an inner side liner of a refrigerator cabinet and a shelf retaining portion, which is connected to the shelf support portion, retaining a portion of each of the two shelves. By disposing one of the packing supports between the two vertically spaced supports on each of the two inner side liners, the two adjustable shelves are prevented from vibrating or movement during shipment irrespective of whether the refrigerator cabinet is upright, on its side, or on its back.

The shelf support portion is connected to the shelf retaining portion along a common edge with the shelf retaining portion bent relative to the shelf support portion when the packing support is to be used. The shelf support portion is slightly greater than the spacing between the supports so that it is retained therebetween against vertical motion.

The shelf retaining portion of the packing support has first receiving means receiving a portion of a first shelf and second receiving means receiving a portion of a second shelf. The first shelf has opposite portions disposed within the first receiving means of each of two of the packing supports exterior of the refrigerator cabinet. Then, the shelf support portion of each of the two packing supports is disposed between the two adjacent vertically spaced supports on each of the inner side liners. Thereafter, the second shelf is positioned within the second receiving means of each of the two packing supports. This compresses the shelf retaining portions so that the packing supports are locked against movement to prevent any vibration or motion of the shelves during shipment of the refrigerator cabinet.

An object of this invention is to provide a packing support for articles during shipment within a cabinet in which each of two of the packing supports on opposite portions of the articles is supported between two vertically spaced article supports on each of the two interior side walls of the cabinet.

Another object of this invention is to provide a packing support for preventing movement of adjustable shelves in a refrigerator cabinet during shipment of the refrigerator cabinet.

Other objects of this invention will be readily perceived from the following description, claims, and drawings.

BRIEF DESCRIPTION OF THE DRAWINGS

The attached drawings illustrate a preferred embodiment of the invention, in which:

FIG. 2 is a fragmentary perspective view of a portion of a refrigerator cabinet and showing one side of an adjustable shelf supported on a shelf support integral with an inner side liner of a refrigerator cabinet;

FIG. 3 is a fragmentary top plan view of portions of a vertically adjustable, slidable shelf with which the packing supports of FIG. 1 are used;

FIG. 5 is a fragmentary front elevational view of a portion of a refrigerator cabinet in which two adjustable shelves are supported by two of the packing supports of FIG. 1 during shipment;

FIG. 6 is a fragmentary perspective view, partly in section, showing the packing support of FIG. 1 disposed between two vertically spaced supports integral with one of the inner side liners of the refrigerator cabinet for preventing motion of the two shelves during shipment;

FIG. 7 a fragmentary side elevational view of a portion of a refrigerator cabinet having another shelf support arrangement with which the packing supports of FIG. 1 may be utilized;

FIG. 8 is a fragmentary top plan view of portions of a vertically adjustable, non-slidable shelf used with the refrigerator cabinet of FIG. 7 and with which the packing supports of FIG. 1 are used;

FIG. 9 is a fragmentary perspective view, partly in section, showing the packing support of FIG. 1 disposed between two vertically spaced supports integral with one of the inner side liners of the refrigerator cabinet for preventing motion of the two shelves during shipment; and FIG. 10 is a fragmentary front elevational view of a portion of the refrigerator cabinet of FIG. 7 in which two adjustable shelves are supported by two of the packing supports of FIG. 1 during shipment.

DESCRIPTION OF THE PREFERRED EMBODIMENT

Figure 1:
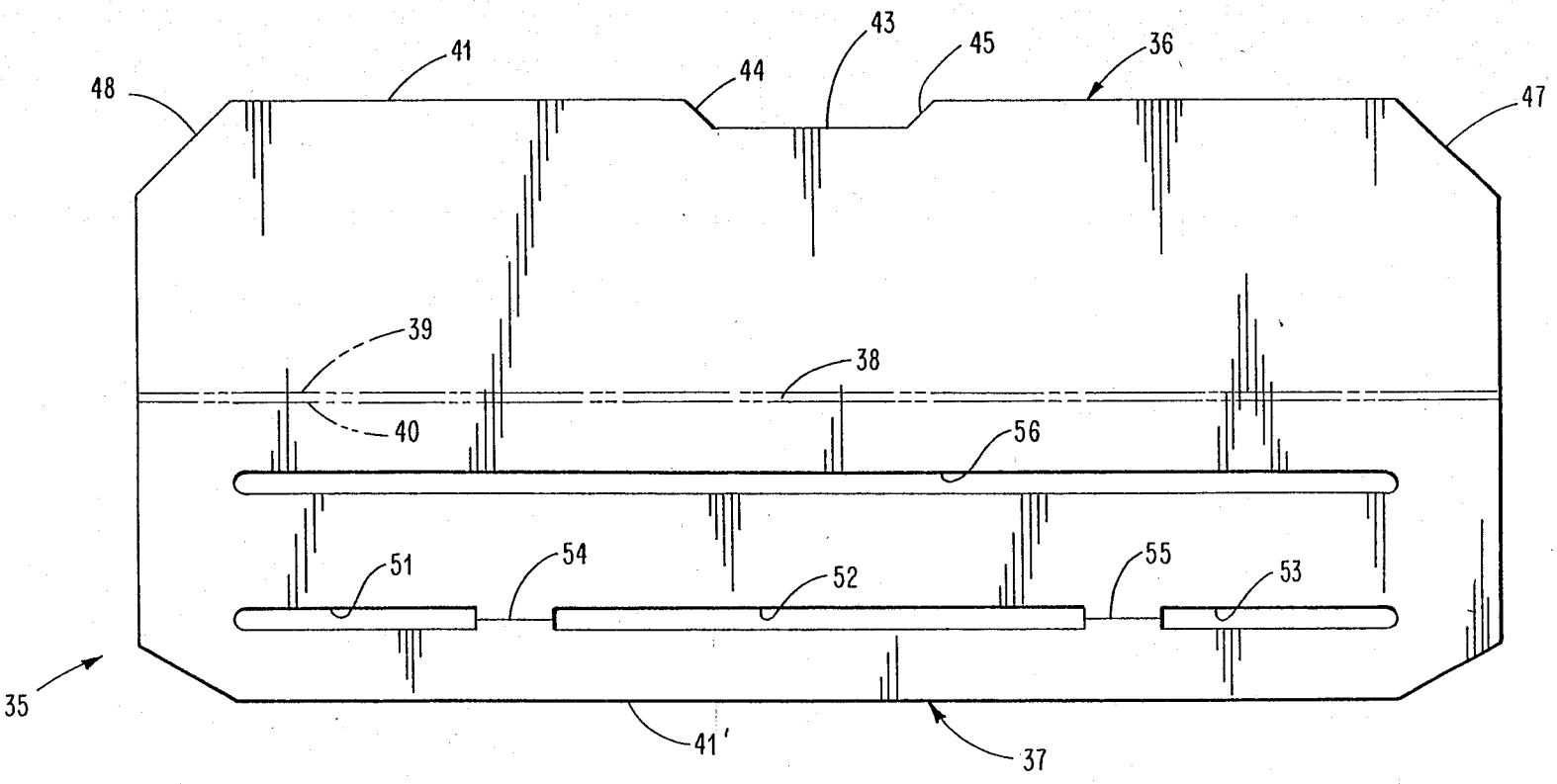
FIG. 1 is a plan view of a packing support of the present invention.

Referring to the drawings and particularly FIG. 5, there is shown a refrigerator cabinet 10 having a pair of inner side liners or walls 11 and 12 joined by an inner rear liner or wall 13. The inner side liner 11 has a plurality of vertically spaced shelf supports (two shown at 14 and 15) formed integral therewith. The inner side liner 12 has the same number of shelf supports (two shown at 16 and 17) as the inner side liner 11.

Figure 4:
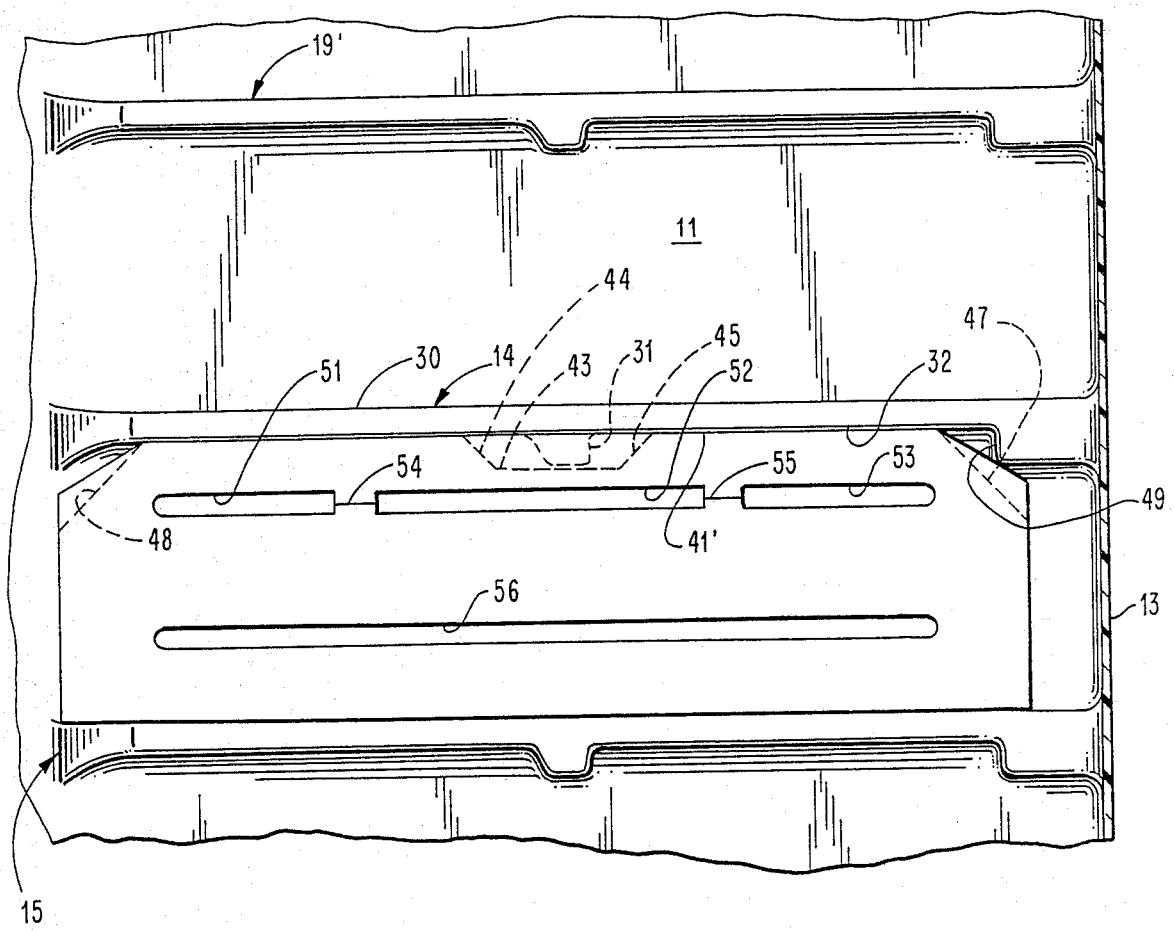
FIG. 4 is a fragmentary side elevational view of a portion of a refrigerator cabinet and showing a packing support of FIG. 1 mounted between two vertically spaced supports integral with an inner side liner of the refrigerator cabinet without any shelf supported therein.

During use, the shelf supports 14 and 16 slidably support a shelf 18 thereon as shown in FIG. 2 for the shelf support 14. During use, the shelf supports 15 (see FIG. 5) and 17 slidably support a shelf 19, which is the same as the shelf 18, thereon. While the inner side liner 11 will have more than the two shelf supports 14 and 15 such as a shelf support 19′ (see FIG. 4), for example, and the inner side liner 12 (see FIG. 5) will have more than the two shelf supports 16 and 17, only the two shelves 18 and 19 are used. Each of the inner side liners 11 and 12 can have as many as five of the shelf supports, for example.

As shown in FIG. 3, the shelf 18 includes a pair of side bars 20 and 21 joined at their front ends by a front bar 22 and at their rear ends by a rear bar 23. An intermediate bar 24 extends between the side bars 20 and 21 between the front bar 22 and the rear bar 23 and substantially parallel to the front bar 22 and the rear bar 23. Each of the side bars 20 and 21 has a front angled portion 25 and a rear angled portion 26.

A plurality of wires 27 is positioned on top of the front bar 22, the intermediate bar 24, and the rear bar 23 and connected to each of the bars 23–25. The wires 27 support articles thereon.

An L-shaped rear hook 28 is attached to the rear bar 23 of the shelf 18 adjacent the side bar 20 and extends downwardly from the rear bar 23. An L-shaped rear hook 29 is attached to the rear bar 23 of the shelf 18 adjacent the side bar 21 and extends downwardly from the rear bar 23.

During use, the shelf 18 is mounted on the shelf supports 14 (see FIG. 5) and 16 by the side bar 20 (see FIG. 2) resting on the shelf support 14 (see FIG. 5) and the side bar 21 (see FIG. 3) resting on the shelf support 16 (see FIG. 5). The shelf support 14, which is the same as each of the shelf supports 15, 16, 17, and 19′ (see FIG. 4), has a top horizontal surface 30 (see FIG. 2) on which the side bar 20 of the shelf 18 is supported. The shelf support 14 has a stop 31 extending downwardly from its lower curved surface 32 intermediate its ends. The stop 31 cooperates with a horizontal portion of the L-shaped hook 28 to limit the distance that the shelf 18 can be pulled from the refrigerator cabinet 10 during use.

During use, the shelf 18 has the side bar 21 (see FIG. 5) similarly supported on a top horizontal surface 34 of the shelf support 16. The hook 29 functions in the same manner as the hook 28.

The shelf 19 is similarly supported on the shelf supports 15 and 17. It should be understood that the shelf 18 or 19 may be supported on other shelf supports such as the shelf support 19′ (see FIG. 4), for example, integral with the inner side liners 11 (see FIG. 5) and 12 of the refrigerator cabinet 10.

During shipment of the refrigerator cabinet 10, a packing support 35 is disposed between the vertically spaced shelf supports 14 and 15 integral with the inner side liner 11. Another of the packing supports 35 is similarly disposed between the vertically spaced shelf supports 16 and 17.

The packing support 35 is formed of a suitable packing material such as corrugated cardboard, for example. Any other material capable of absorbing vibrations and having a memory so that the material returns substantially to its position prior to being subjected to a force may be employed.

As shown in FIG. 1, each of the packing supports 35 includes a first or shelf support portion 36 and a second or shelf retaining portion 37. The portions 36 and 37 are connected to each other along a common or connecting edge 38, which is defined by a pair of score lines 39 and 40 to enable bending of the portions 36 and 37 relative to each other to about 180°. Prior to bending, the portions 36 and 37 are in a single common plane.

The distance from the score line 39 to an edge 41 of the shelf support portion 36 is the same as the distance from the score line 40 to an edge 41′ of the shelf retaining portion 37. Thus, when the portions 36 and 37 are bent relative to each other, they extend substantially the same distance from the common edge 38.

The distance between the score line 39 and the edge 41 of the shelf support portion 36 is slightly greater than the distance between portions of the lower curved surface 32 (see FIG. 5) of the shelf support 14 and a top horizontal surface 42 of the shelf support 15. The same relationship exists with respect to the shelf supports 16 and 17. Thus, the shelf support portion 36 of the packing support 35 is retained between the shelf supports 14 and 15 or the shelf supports 16 and 17 so that there is no vertical or fore and aft movement of the packing support 35.

The edge 41 (see FIG. 1) of the shelf support portion 36 has a notch 43 intermediate its ends with inclined surfaces 44 and 45. The inclined surfaces 44 and 45 enable the notch 43 to cam past the stop 31 (see FIG. 4) or a similar stop 46 (see FIG. 5) on the shelf support 16.

The notch 43 (see FIG. 4) receives the stop 31 so that the shelf support portion 36 (see FIG. 5) can fit against the inner side liner 11. The notch 43 (see FIG. 4) also prevents the shelf support portion 36 (see FIG. 5) from buckling out.

The edge 41 (see FIG. 1) of the shelf support portion 36 of the packing support 35 has inclined surfaces 47 and 48 at its ends. Since the packing support 35 is used with either the shelf supports 14 (see FIG. 5) and 15 or the shelf supports 16 and 17 so that it is reversed depending on which of the shelf supports 14 and 15 or 16 and 17 that it is mounted, the inclined surface 47 (see FIG. 1) will fit beneath a rear stop 49 (see FIG. 4) of the shelf support 14 against which the end of the L-shaped hook 28 (see FIG. 5) bears when the shelf 18 is supported on the shelf supports 14 and 16 for use. The inclined surface 48 (see FIG. 1) of the packing support 35 fits beneath a similar rear stop (not shown) on the shelf support 16 (see FIG. 5) against which the end of the L-shaped hook 29 bears when the shelf 18 is supported on the shelf supports 14 and 16 for use.

The shelf retaining portion 37 (see FIG. 1) has three spaced longitudinal slots 51, 52, and 53, which are slightly smaller in thickness than the side bar 20 (see FIG. 3) or 21 of the shelf 18 or 19 (see FIG. 5), in alignment with each other. The slot 52 (see FIG. 1) is twice the length of each of the slots 51 and 53 although such is not a requisite for satisfactory operation. The shelf retaining portion 37 of the packing support 35 has a first slit 54 formed therein between the slots 51 and 52 and a second slit 55 formed therein between the slots 52 and 53.

Prior to disposing the shelf support portion 36 between the shelf supports 14 (see FIG. 4) and 15, the longitudinal slots 51–53 and the slits 54 and 55 receive portions of the side bar 20 (see FIG. 5) of the shelf 18. Prior to disposing the shelf support portion 36 of the packing support 35 between the shelf supports 16 (see FIG. 5) and 17, the longitudinal slots 51 (see FIG. 1), 52, and 53 and the slits 54 and 55 receive portions of the side bar 21 (see FIG. 3 of the shelf 18.

After the packing supports 35 (see FIG. 1) have been mounted on the side bars 20 (see FIG. 3) and 21 of the shelf 18, the shelf support portion 36 (see FIG. 5) of one of the packing supports 35 is slid between the shelf supports 14 and 15 and the shelf support portion 36 of another of the packing supports 35 is slid between the shelf supports 16 and 17 as shown in FIG. 5. The shelf 18 compresses the shelf support portion 36 of each of the packing supports 35 against the inner side liners 11 and 12.

Then, the second shelf 19 is inserted into the refrigerator cabinet 10 and has the side bar 20 disposed within a longitudinal slot 56 (see FIG. 1) in the shelf retaining portion 37 of the packing support 35. The longitudinal slot 56, which has the same length as the sum of the lengths of the slots 51, 52, and 53 and the slits 54 and 55, is slightly smaller in thickness than each of the side bars 20 (see FIG. 5) and 21 of the shelf 19.

As the second shelf 19 is advanced into the refrigerator cabinet 10 so that the side bars 20 and 21 of the shelf 19 enter the longitudinal slot 56 (see FIG. 1) in each of the two packing supports 35, there is compression of the area of the shelf retaining portion 37 over which the side bar 20 (see FIG. 5) or 21 passes prior to entering the longitudinal slot 56 (see FIG. 1). Because the packing support 35 is formed of a material having a memory such as corrugated cardboard, for example, the material will return to substantially its initial position after the side bars 20 (see FIG. 5) and 21 are disposed in the longitudinal slot 56 (see FIG. 1) in each of the packing supports 35. This position of the second shelf 19 (see FIG. 5) in conjunction with the first shelf 18 holds the shelf retaining portion 37 of each of the packing supports 35 with sufficient lateral force so that there can be no side to side movement of the shelves 18 and 19.

The thickness of the packing support 35 is selected so that it is equal to or greater than the distance between the side bar 20 of the shelf 18 or 19 and the inner side liner 11 or between the side bar 21 of the shelf 18 or 19 and the inner side liner 12. Thus, as shown in FIG. 5, the side bar 20 of each of the shelves 18 and 19 is bearing against the shelf support portion 36 of the packing support 35 between the shelf supports 14 and 15 and the side bar 21 of each of the shelves 18 and 19 is bearing against the shelf support portion 36 of the packing support 35 between the shelf supports 16 and 17. This prevents any lateral movement of the packing supports 35.

While the refrigerator cabinet 10 has been shown and described as having the two shelves 18 and 19 and the packing supports 35 retaining the two shelves 18 and 19 against movement during shipment, it should be understood that there could be more than two of the shelves 18 and 19. If the vertical spacing between the shelf supports 14 and 15 were further apart so that the packing support 35 could be of a greater distance between the edges 41 (see FIG. 1) and 41', then the packing supports 35 could support more than the two shelves 18 (see FIG. 5) and 19. This would necessitate the self retaining portion 37 (see FIG. 1) of the packing support 35 having additional receiving means corresponding to the longitudinal slot 56, for example, to receive each additional shelf.

Referring to FIG. 10, there is shown a refrigerator cabinet 60 having a pair of inner side liners or walls 61 and 62 joined by an inner rear liner or wall 63. The inner side liner 61 has a plurality of vertically spaced shelf supports (two shown at 64 and 65) formed integral therewith. The inner side liner 62 has the same number of shelf supports (two shown at 66 and 67) as the inner side liner 62.

During use, the shelf supports 64 and 66 support a shelf 68 thereon. During use, the shelf supports 65 and 67 support a shelf 69, which is the same as the shelf 68, thereon.

While the inner side liner 61 will have more than the two shelf supports 64 and 65 such as a shelf support 70 (see FIG. 7), for example, on which the shelf 68 may be supported as shown in phantom and the inner side liner 62 (see FIG. 10) will have more than the two shelf supports 66 and 67, only the two shelves 68 and 69 are used. Each of the inner side liners 61 and 62 can have as many as five of the shelf supports, for example.

It should be understood that the shelf supports 64 and 65 are spaced further apart from each other than each is spaced from an adjacent shelf support on the inner side liner 61 such as the shelf support 64 is spaced from the shelf support 70 (see FIG. 7) and that the fifth shelf support on the inner side liner 61 is spaced the same distance from the adjacent shelf support as the shelf support 70 is spaced from the shelf support 64. The shelf supports 66 (see FIG. 10) and 67 are similarly spaced further apart from each other than each is spaced from the adjacent shelf support on the inner side liner 62 and the fifth shelf support on the inner side liner 62 is spaced the same distance from the adjacent shelf support as the shelf support 70 (see FIG. 7) is spaced from the shelf support 64.

Each of the shelf supports on the inner side liners 61 and 62 (see FIG. 10) including the shelf supports 64–67 and 70 (see FIG. 7) is formed of a front portion 71 and a rear portion 72 spaced from each other as shown in FIG. 7. This spacing between the front portion 71 and rear portion 72 enables a downwardly extending projection 73 on the shelf 68 to be disposed therebetween when the shelf 68 is supported thereon.

The projection 73 is a portion of a side bar 74 (see FIG. 8) of a rectangular shaped frame 75 of the shelf 68. The frame 75 includes a side bar 76, which is substantially parallel to the side bar 74 and has a downwardly extending projection 77 for disposition between the front portion 71 (see FIG. 7) and the rear portion 72 of one of the shelf supports on the inner side liner 62 (see FIG. 10). The frame 75 (see FIG. 8) also includes a front bar 78 joining the front ends of the side bars 74 and 76 and a rear bar 79 extending between the rear ends of the side bars 74 and 76.

An intermediate bar 80 extends between the side bars 74 and 76 and substantially parallel to the front bar 78 and the rear bar 79. A plurality of wires 81 is positioned on top of the front bar 78, the intermediate bar 80, and the rear bar 79 and connected to each of the bars 78–80. The wires 81 support articles thereon.

During use, the side bar 74 of the shelf 68 rests on the shelf support 64 (see FIG. 10) and the side bar 76 of the shelf 68 rests on the shelf support 66. The shelf 69 is similarly supported on the shelf supports 65 and 67. It should be understood that the shelves 68 and 69 may be supported on other of the shelf supports on the inner side liners 61 and 62.

During shipment of the refrigerator cabinet 60, one of the packing supports 35 is disposed between the vertically spaced shelf supports 64 and 65. Another of the packing supports 35 is similarly disposed between the vertically spaced shelf supports 66 and 67.

It is necessary for the packing supports 35 to support the shelves 68 and 69 so that the side bar 74 of the shelf 68 is completely received within the longitudinal slots 51 (see FIG. 9), 52, and 53 of the packing support 35 between the shelf supports 64 and 65 and the side bar 76 (see FIG. 8) of the shelf 68 is completely received within the longitudinal slots 51 (see FIG. 1), 52, and 53 of the packing support 35 between the shelf supports 66 (see FIG. 10) and 67. Likewise, it is necessary for the longitudinal slot 56 (see FIG. 9) of the packing support 35 between the shelf supports 64 and 65 on the inner side liner 61 to receive the side bar 74 (see FIG. 10) of the shelf 69 and the longitudinal slot 56 (see FIG. 1) in the packing support 35 between the shelf supports 66 (see FIG. 10) and 67 to receive the side bar 76 of the shelf 69.

As a result, the length of the longitudinal slot 56 (see FIG. 1) in each of the packing supports 35 is longer than that shown in FIG. 1. Similarly, the length of each of the longitudinal slots 51 and 53 is likewise extended. However, the length of the longitudinal slot 56 is the same as the sum of the lengths of the slots 51, 52, and 53 and the slits 54 and 55. Thus, the only difference for the packing support 35 for use with the shelves 68 (see FIG. 10) and 69 rather than the shelves 18 (see FIG. 5) and 19 is the lengthening of the slots 51 (see FIG. 1), 53, and 56. Of course, the longitudinal slot 52 also could be lengthened, if desired, to maintain the length of the slot 52 twice the length of each of the slots 51 and 53.

Each of the longitudinal slots 51, 52, 53, and 56 is slightly smaller in thickness than each of the side bars 74 (see FIG. 8) and 76 of each of the shelves 68 and 69 (see FIG. 10). This insures that the shelves 68 and 69 will remain between the shelf support portion 36 and the shelf retaining portion 37.

Because of the projections 73 and 77, the shelf retaining portion 36 of each of the packing supports 35 cannot be disposed between the shelf supports 64 and 65 or 66 and 67 until the side bars 74 and 76 of the shelf 68 have been received within the longitudinal slots 51 (see FIG. 1), 52, and 53 and the slits 54 and 55 of each of the packing supports 35 and the side bars 74 (see FIG. 10) and 76 of the shelf 69 have been received within the longitudinal slot 56 (see FIG. 1) in each of the packing supports 35. The projections 73 (see FIG. 10) and 77 on each of the shelves 68 and 69 must be maneuvered into the appropriate longitudinal slot 52 (see FIG. 1) or 56 in the packing support 35. This cannot be accomplished when the packing supports 35 cannot be moved away from each other.

It should be understood that the shelf supports 14 (see FIG. 4) and 15 could be spaced further apart from each other than each is spaced from the adjacent shelf support on the inner side liner 11 such as the shelf support 14 is spaced from the shelf support 19′ and that the fifth shelf support on the inner side liner 11 could be spaced the same distance from the adjacent shelf support as the shelf support 19′ could be spaced from the shelf support 14. The shelf supports 16 (see FIG. 5) and 17 could be similarly spaced further apart from each other than each is spaced from the adjacent shelf support on the inner side liner 12 and the fifth shelf support on the inner side liner 12 could be spaced the same distance from the adjacent shelf support as the shelf support 19′ (see FIG. 4) could be spaced from the shelf support 14.

While the packing supports 35 (see FIG. 5) of the present invention have been shown and described for retaining the shelves 18 and 19 in the refrigerator cabinet 10 or the shelves 68 (see FIG. 10) and 69 in the refrigerator cabinet 60 during shipment, it should be understood that the packing support 35 of the present invention could be utilized to prevent movement during shipment of any articles, which are slidably supported on vertically spaced supports on opposite side walls of a cabinet. Of course, because of the shape of such articles, the first and second receiving means for each of the articles might have to be changed from that shown in the packing support 35 for the shelves 18 (see FIG. 5) and 19 or the shelves 68 (see FIG. 10) and 69.

An advantage of this invention is that slidably supported articles may be shipped within a cabinet and prevented from movement. Another advantage of this invention is that adjustable shelves of a refrigerator cabinet are prevented from moving during shipment of the refrigerator cabinet. A further advantage of this invention is that damage to a refrigerator cabinet liner by support hooks extending from sides of a shelf is avoided during shipment of the refrigerator cabinet.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

We claim:

1. A packing support for supporting a portion of each of at least two articles during shipment within the interior of a cabinet having a plurality of vertically spaced supports on each of its inner side walls for slidably supporting each of the articles when the cabinet is supported on a stationary surface, said packing support including:

a member of corrugated cardboard including:

a first portion;

a second portion;

means connecting said first portion to said second portion so that said first portion and said second portion may be bent from a single common plane to be substantially adjacent each other when supporting a portion of each of the articles;

each of said first portion and said second portion being substantially planar when bent to be substantially adjacent each other;

each second portion in its entirety being closer to the articles being supported than said first portion;

said first portion having a dimension in a direction substantially perpendicular to said connecting means slightly greater than the distance between two adjacent vertically spaced article supports on each of the inner side walls of the cabinet within which said first portion is to be retained so that said first portion is retained between the two adjacent vertically spaced article supports against movement therebetween;

said second portion having:

first receiving means for receiving a portion of one of the articles for support thereby;

and second receiving means for receiving a portion of at least one other of the articles for support thereby;

each of said first receiving means and said second receiving means having no engagement with said first portion when said first portion and said second portion are bent to be substantially adjacent each other when supporting a portion of each of the supported articles;

and said second portion being compressed towards said first portion when another of said packing supports has said second portion of said member supporting another portion of each of the supported articles.

2. The packing support according to claim 1 in which said first receiving means includes retaining means for retaining the portion of the one article.

3. The packing support according to claim 1 in which said first portion has means for fitting beneath a rear portion of the upper of the two adjacent vertically spaced article supports on the inner side wall of the cabinet between which said first portion is retained.

4. The packing support according to claim 1 in which:

said first receiving means includes longitudinal slot means for receiving the portion of the one article to be supported thereby;

and said second receiving means includes longitudinal slot means for receiving the portion of the other article to be supported thereby.

5. A packing support for supporting a portion of each of at least two articles during shipment within the interior of a cabinet having a plurality of vertically spaced supports on each of its inner side walls for slidably supporting each of the articles when the cabinet is supported on a stationary surface, said packing support including:

a member of corrugated cardboard including:

a first portion;

a second portion;

means connecting said first portion to said second portion so that said first portion and said second portion may be bent from a single common plane to be substantially adjacent each other when supporting a portion of each of the articles;

said first portion having a dimension in a direction substantially perpendicular to said connecting means slightly greater than the distance between two adjacent vertically spaced article supports on each of the inner side walls of the cabinet within which said first portion is to be retained so that said first portion is retained between the two adjacent vertically spaced article supports against movement therebetween;

said second portion having:

first receiving means for receiving a portion of one of the articles for support thereby;

and second receiving means for receiving a portion of at least one other of the articles for support thereby;

said second portion being compressed towards said first portion when another of said packing supports has said second portion of said member supporting another portion of each of the supported articles;

said first receiving means including retaining means for retaining the portion of the one article;

said first receiving means including three spaced longitudinal slots in said second portion, each of said three spaced longitudinal slots having a slightly smaller thickness than the portion of the one article to be received in said three spaced longitudinal slots;

and said retaining means of said first receiving means including:

a first slit in said second portion between two of said three spaced longitudinal slots;

and a second slit in said second portion between a third of said three spaced longitudinal slots and the adjacent of said two slots of said three spaced longitudinal slots;

each of said first slit and said second slit retaining the portion of the one article received therein.

6. The packing support according to claim 5 in which said second receiving means includes a single longitudinal slot disposed closer to said connecting means than said three spaced longitudinal slots, said single longitudinal slot having a slightly smaller thickness than the portion of the one other article to be received therein.

7. The packing support according to claim 6 in which said first portion has means to fit beneath a rear portion of the upper of the two adjacent vertically spaced article supports on the inner side wall of the cabinet between which said first portion is retained.

8. The packing support according to claim 7 in which said single longitudinal slot extends for substantially the same length as the sum of the lengths of said three spaced longitudinal slots and said two slits.

9. The packing support according to claim 6 in which said single longitudinal slot extends for substantially the same length as the sum of the lengths of said three spaced longitudinal slots and said two slits.

10. A packing support for supporting a portion of each of at least two shelves during shipment within the interior of a refrigerator cabinet having a plurality of vertically spaced shelf supports on each of its inner side walls for supporting each of the shelves when the refrigerator cabinet is supported on a stationary surface, said packing support including:

a member of corrugated cardboard including:

a first portion;

a second portion;

means connecting said first portion to said second portion so that said first portion and said second portion may be bent from a single common plane to be substantially adjacent each other when supporting a portion of each of the shelves;

each of said first portion and said second portion being substantially planar when bent to be substantially adjacent each other;

said second portion in its entirety being closer to the shelves being supported than said first portion;

said first portion having a dimension in a direction substantially perpendicular to said connecting means slightly greater than the distance between two adjacent shelf supports on each of the inner side walls of the refrigerator cabinet within which said first portion is to be retained so that said first portion is retained between the two adjacent shelf supports against movement therebetween;

said second portion having:

first receiving means for receiving a portion of one of the shelves for support thereby;

and second receiving means for receiving a portion of at least one other of the shelves;

each of said first receiving means and said second receiving means having no engagement with said first portion when said first portion and said second portion are bent to be substantially adjacent each other when supporting a portion of each of the shelves;

and said second portion being compressed towards said first portion when another of said packing supports has said second portion of said member supporting an opposite portion of each of the supported shelves.

11. The packing support according to claim 10 in which said first receiving means includes retaining means for retaining the portion of the one shelf.

12. The packing support according to claim 10 in which said first portion has means for fitting beneath a real portion of the upper of the two adjacent vertically spaced shelf supports on the inner side wall of the refrigerator cabinet within which said first portion is retained.

13. The packing support according to claim 10 in which:

said first receiving means includes longitudinal slot means for receiving a portion of the one shelf to be supported thereby;

and said second receiving means includes longitudinal slot means for receiving the portion of the other shelf to be supported thereby.

14. A packing support for supporting a portion of each of at least two shelves during shipment within the interior of a refrigerator cabinet having a plurality of vertically spaced shelf support on each of its inner side walls for supporting each of the shelves when the refrigerator cabinet is supported on a stationary surface, said packing support including:

a member of corrugated cardboard including:

a first portion;

a second portion;

means connecting said first portion to said second portion so that said first portion and said second portion may be bent from a single common plane to be substantially adjacent each other when supporting a portion of each of the shelves;

said first portion having a dimension in a direction substantially perpendicular to said connecting means slightly greater than the distance between two adjacent shelf supports on each of the inner side walls of the refrigerator cabinet within which said first portion is to be retained so that said first portion is retained between the two adjacent shelf supports against movement therebetween;

said second portion having:

first receiving means for receiving a portion of one of the shelves for support thereby;

and second receiving means for receiving a portion of at least one other of the shelves;

said second portion being compressed towards said first portion when another of said packing supports has said second portion of said member supporting an opposite portion of each of the supported shelves;

said first receiving means including retaining means for retaining the portin of the one shelf;

said first receiving means including three longitudinal slots in said second portion, each of said three spaced longitudinal slots having a slightly smaller thickness than the portion of the one shelf to be received in said three spaced longitudinal slots;

and said retaining means of said first receiving means including:

a first slit in said second portion between two of said three spaced longitudinal slots;

and a second slot in said second portion between a third of said three spaced longitudinal slots in the adjacent of said two slots of said three spaced longitudinal slots;

each of said first slit and said second slit retaining the portion of the one shelf received therein.

15. The packing support according to claim 14 in which said second receiving means includes a single longitudinal slot disposed closer to said connecting means than said three spaced longitudinal slots, said single longitudinal slot having a slightly smaller thickness than the portion of the one other shelf to be received therein.

16. The packing support according to claim 15 in which said first portion has means to fit beneath a rear portion of the upper of the two adjacent vertically spaced shelf supports on the inner side wall of the refrigerator cabinet within which said first portion is retained.

17. The packing support according to claim 16 in which said single longitudinal slot extends for substantially the same length as the sum of the lengths of said three spaced longitudinal slots and said two slits.

18. The packing support according to claim 15 in which said single longitudinal slot extends for substantially the same length as the sum of the lengths of said three spaced longitudinal slots and said two slits.

19. A method of packing at least two shelves within a refrigerator cabinet during shipment to retain each of the shelves against movement in which the refrigerator cabinet has a plurality of vertically spaced shelf supports on each of its inner side walls extending into the interior of the refrigerator cabinet for supporting opposite portions of each of the shelves when the refrigerator cabinet is supported on a stationary surface including:

positioning a portion of one of the shelves in first receiving means in a shelf support portion of a first packing support and an opposite portion of the one shelf in first receiving means in a shelf support portion of a second packing support;

positioning a portion of at least one other of the shelves in second receiving means in the shelf support portion of the first packing support and an opposite portion of at least the one other shelf in second receiving means in the shelf support portion of the second packing support;

and positioning a retaining portion of the first packing support between two adjacent vertically spaced shelf supports on one of the inner side walls of the refrigerator cabinet and a retaining portion of the second packing support between two adjacent vertically spaced shelf supports on the other of the inner side walls of the refrigerator cabinet so that movement of each of the first packing support and the second packing support in a vertical direction between the pairs of vertically spaced shelf supports is prevented;

the one other shelf cooperating with the one shelf to hold the shelf support portions of the first packing support and the second packing support so that the first packing support and the second packing support cannot move in a fore and aft direction.

20. The method according to claim 19 including positioning the retaining portion of the first packing support between the two adjacent vertically spaced shelf supports on the one inner side wall of the refrigerator cabinet and the retaining portion of the second packing support between the two adjacent vertically spaced shelf supports on the other inner side wall of the refrigerator cabient prior to positioning a portion of at least the one other shelf in the second receiving means in the shelf support portion of the first packing support and an opposite portion of at least the one other shelf in the second receiving means in the shelf support portion of the second packing support.

21. The method according to claim 19 including positioning the retaining portion of the first packing support between the two adjacent vertically spaced shelf supports on the one inner side wall of the refrigerator cabinet and the retaining portion of the second packing support between the two adjacent vertically spaced shelf supports on the other inner side wall of the refrigerator cabinet after positioning a portion of at least the one other shelf in the second receiving means in the shelf support portion of the first packing support and an opposite portion of at least the one other shelf in the second receiving means in the shelf support portion of the second packing support.

22. The method according to claim 19 in which the retaining portion and the shelf support portion of each packing support extend the same distance from connecting means that permit the retaining portion and the shelf support portion to be bent relative to each other from a common single plane until the retaining portion and the shelf support portion are substantially adjacent each other.

23. In combination:

a cabinet having a pair of inner side walls substantially parallel to each other;

each of said inner side walls having a plurality of vertically spaced supports thereon;

a plurality of articles with each of said articles being slidably supported on one of said vertically spaced supports on each of said inner side walls when said cabinet is supported on a stationary surface;

a packing support for supporting a portion of each of at least two of said articles during shipment within the interior of said cabinet;

said packing support including:

a member of corrugated cardboard including:

a first portion;

a second portion;

means connecting said first portion to said second portion so that said first portion and said second portion may be bent from a single common plane to be substantially adjacent each other when supporting a portion of each of the articles;

said first portion having a dimension in a direction substantially perpendicular to said connecting means slightly greater than the distance between two adjacent of said vertically spaced article supports on each of said inner side walls of said cabinet within which said first portion is to be retained so that said first portion is retained between said two adjacent vertically spaced article supports on one of said inner side walls against movement therebetween;

said second portion having:

first receiving means for receiving a portion of one of said articles for support thereby;

and second receiving means for receiving a portion of at least one other of said articles for support thereby;

and said second portion being compressed towards said first portion when another of said packing supports has said second portion of said member supporting another portion of each of said supported articles.

* * * * *